United States Patent [19]

von Hackewitz

[11] Patent Number: 4,995,608

[45] Date of Patent: Feb. 26, 1991

[54] STRINGED FRAME WITH ADJUSTABLE TENSIONING

[76] Inventor: Friedrich-Wilhelm von Hackewitz, 8720 Schweinfurt, Lauerweg 2, Fed. Rep. of Germany

[21] Appl. No.: 342,227

[22] Filed: Apr. 24, 1989

[30] Foreign Application Priority Data

Apr. 25, 1988 [DE] Fed. Rep. of Germany ..... 3813872

[51] Int. Cl.[5] ..... A63B 51/12

[52] U.S. Cl. ..... 273/73 E; 273/73 B; 273/73 C; 273/73 G

[58] Field of Search ..... 273/73 B, 73 E, 73 C, 273/73 G

[56] References Cited

U.S. PATENT DOCUMENTS

| | | | |
|---|---|---|---|
| 1,862,581 | 9/1927 | Robinson | 273/73 E |
| 2,206,548 | 5/1940 | Goerke | 273/73 E |
| 3,904,202 | 9/1975 | DeLorean | 273/73 E |
| 4,099,717 | 6/1978 | Sacks | 273/73 E |
| 4,102,533 | 7/1978 | Ida | 273/73 E |

FOREIGN PATENT DOCUMENTS

| | | | |
|---|---|---|---|
| 151916 | 12/1953 | Australia | 273/73 G |
| 3343300 | 2/1985 | Fed. Rep. of Germany | 273/73 E |
| 3615123 | 5/1987 | Fed. Rep. of Germany . | |

*Primary Examiner*—Benjamin Layno
*Assistant Examiner*—Raleigh W. Chiu
*Attorney, Agent, or Firm*—Rosen, Dainow & Jacobs

[57] ABSTRACT

A frame (1), for example for a tennis racket, is arranged in a plane and is designed to be deformable by bending within its plane and is strung on its interior with strings (2) or the like under tension. At a junction, the frame (1) is fixedly joined to a rigid holding member (3). At the junction, tensioning members are arranged for adjusting the magnitude of the tension in the stringing (2). So that the frame (1) may be especially simple and economical to produce, at its junction with the holding member (3), it has two ends (4,5) arranged at a short distance from each other and movable relative to each other in the circumferential direction of the frame (1), which ends are fixedly joined to the holding member (3) by one brace (7,8) each, deformable in the plane of the frame (1) by bending. The tensioning members comprise at least one adjusting element (9) pushing or pulling the two ends (4,5) more or less towards or away from each other.

5 Claims, 3 Drawing Sheets

FIG. 3
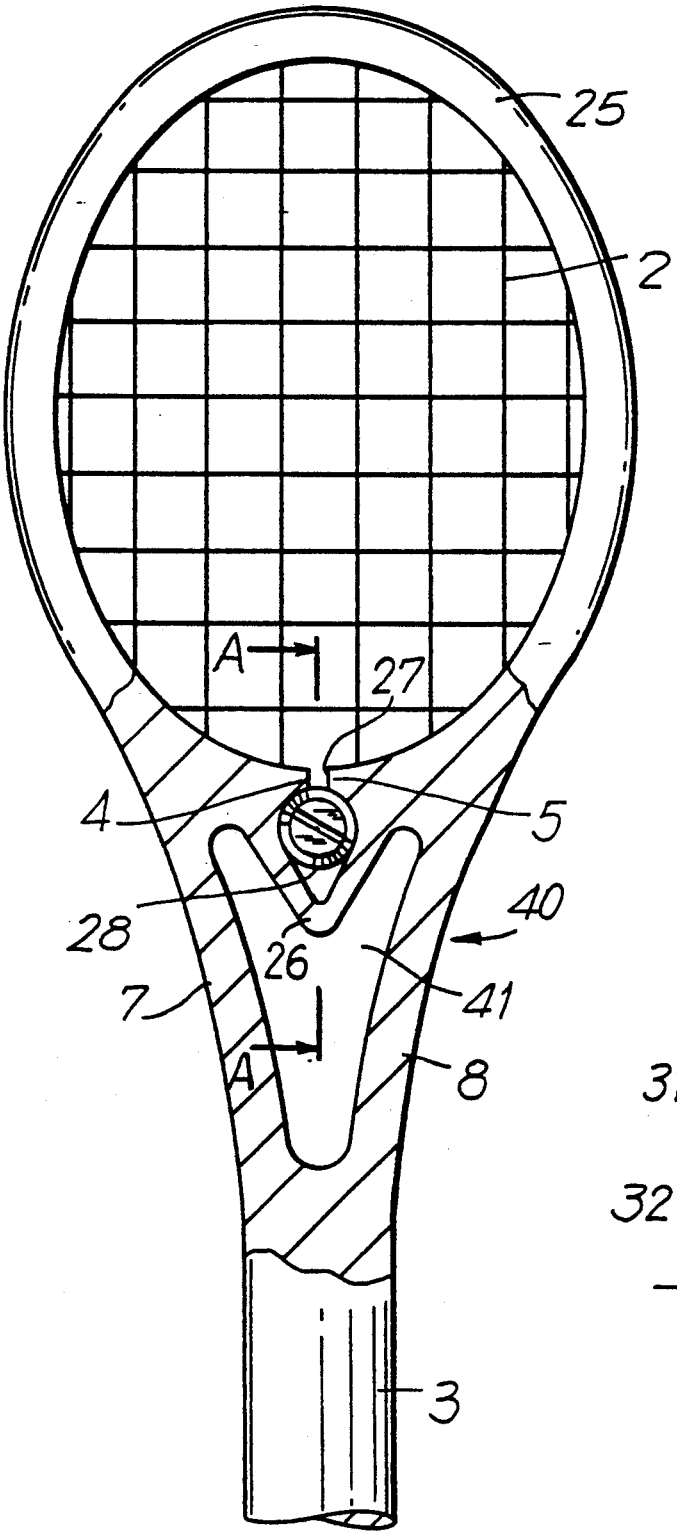
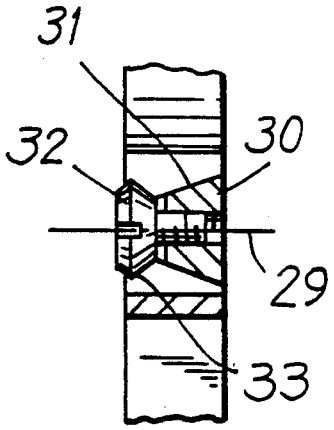
FIG. 4

STRINGED FRAME WITH ADJUSTABLE TENSIONING

The present invention relates to a frame strung with strings or the like under tension, and in particular to a frame for a tennis racket.

BACKGROUND OF THE INVENTION

Racket frames are known in which the frame, arranged in a plane, is deformable within the plane by bending, and is strung on its interior with strings or the like under tension and fixedly joined to a rigid holding member at a junction. Tensioning means are arranged at the frame junction to adjust the magnitude of the tension in the strings.

A known frame of the kind referred to has load-transmitting members arranged along the frame (German Letters of Disclosure 3,615,123). The accommodation of these members in or on the frame is troublesome and costly in some cases.

SUMMARY OF THE INVENTION

An object of the invention is to provide an improved frame of the type described above, in which the disadvantages of the known frame are mitigated or avoided.

Another object of the invention is a frame of the type described that is especially simple and economical to produce.

In accordance with one aspect of the invention, the frame at its junction with the holding member has two ends movable relative to each other in the circumferential direction of the frame. The two ends are arranged at a short distance from each other, and each of which ends is fixedly joined to the holding member by a brace deformable in the plane of the frame by bending. In this aspect of the invention, the tensioning means comprise at least one adjusting element pushing or pulling the two ends more or less towards or away from each other.

In a preferred embodiment, the two ends of the frame are separated from each other by a gap passing transversely through the frame.

In a further preferred embodiment, the two ends of the frame are joined together by at least one shackle or the like elastically and/or elastically deformable in the circumferential direction of the frame.

In another preferred embodiment, the adjusting element comprises at least one adjusting screw arranged between the two braces and positively joining the two ends of the frame together.

The effect of the invention according to the principal aspect is that the frame, which has two ends in proximity to each other, with the aid of the adjusting element, may be pushed or pulled somewhat toward or away from each other against the resistance of the frame and the two braces to elastic and/or plastic bending. The frame and the two braces are preferably flexible only within the plane of the frame, not transverse to said plane. The frame, when used, for example, as the frame of a tennis racket, may be made economically of wood, metal and/or plastic in traditional manner, and fixedly joined in one piece with the rigid holding member, which may be, for example, the handle of a tennis racket.

An advantage of the preferred embodiment employing a gap, transverse to the is that a conventional frame may be used, merely cut completely or partly in the region between the two braces, so that a narrow gap is formed between the two ends of the frame. An advantage of the shackle feature is that the two ends of the frame are joined together as by a rib. This rib or shackle may be of such shape that in the use of the frame, for example, under impact stresses on the frame of a tennis racquet, resulting relative motions or vibrations of the two ends are prevented or at least damped to a large extent.

A feature of the construction of the invention is the expedient configurations of the adjusting element for adjusting the two ends of the frame relative to each other to the distance from each other required for the desired tension in the stringing of the frame.

SUMMARY OF THE DRAWINGS

The frame according to the invention, strung with strings or the like under tension, will now be described in more detail in terms of three embodiments by way of example, reference being had to the drawings wherein:

FIG. 3 shows a top view, in partial section, of a further modified frame having a deformable shackle joining the two ends of the frame together, and FIG. 4 shows a section along the line A—A of FIG. 3.

DETAILED DESCRIPTION OF PREFERRED EMBODIMENTS

Figure 1:
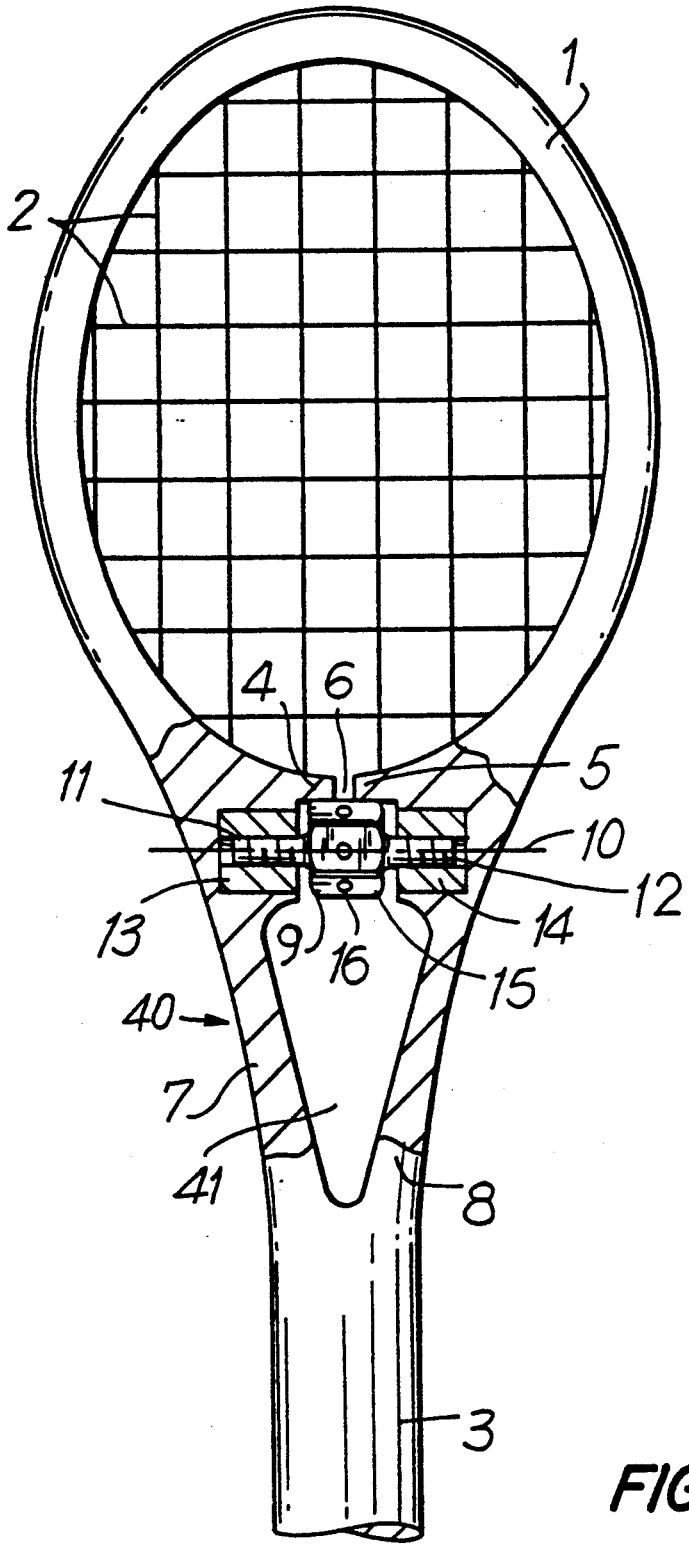
FIG. 1 shows a top view, in partial section, of a frame, with a gap passing transversely through the same.

In FIG. 1, 1 designates a frame, disposed in a plane, of the head portion of a tennis racket, designed to be deformable be elastic bending substantially within that plane only, and made of wood, metal or plastic in conventional manner. The frame 1 is strung on its interior with cut or plastic strings 2 extending under tension in the plane of the frame 1.

At a junction at the bottom, the frame 1 is fixedly joined to a rigid holding member 3, namely the handle of the racket. With the aid of tensing means arranged at this junction, the magnitude of the tension in the stringing 2 can be varied and adjusted.

At its junction, the frame 1 divides to form a throat portion 40 defined at the top by frame ends 4, 5 and at the sides by braces 7, 8. The two ends 4, 5 are separated from each other by a gap 6 passing transversely and completely through the frame 1. Each of the two ends 4 5 is fixedly joined in one piece with the holding member 3 by the braces 7, 8 extending in the plane of the racquet and deformable by elastic bending substantially in that plane only.

Tensioning means are provided comprising an adjusting element pushing or pulling the two ends 4, 5 more or less towards or away from each other. In the present case, the adjusting element is an adjusting screw arranged between the two braces 7, 8 inside the throat opening 41 and positively joining the two ends 4, 5 of the frame 1 to each other.

The adjusting screw g has a straight centerline 10 extending more or less parallel to the frame 1 at the junction of the frame 1 to the holding member 3. Also, the adjusting screw 9 has an end 11 threaded with a right-hand thread and an opposing end 12 threaded with a left-hand thread. The right-hand threaded end 11 is screwed into a threaded hole in one end 4 of the frame 1, and the left-hand threaded end 12 into a threaded hole in the other frame end 5. The two threaded holes are each cut in a metal liner 13, 14. The liner 13 on the left of the drawing (FIG. 1) is fixed in the left-hand end 4 of the frame 1 and the liner 14 on the right is fixed in the right-hand end of the frame 1.

Between the right-hand threaded end 11 and the left-hand end 12, the adjusting screw 9 has a hexagonal segment 15 joined in one piece with both ends 11, 12. The rotational position of the adjusting screw 9 in the two liners 13, 14 can be varied with the aid of a wrench (not shown) taking hold on the hexagonal segment 15. By any known means (not shown), the rotational position of the adjusting screw 9 can be fixed if desired after it has been rotated to the proper adjustment of the tension in the strings 2. As will be evident, when the screw 9 is rotated to spread apart the frame ends 4,5, the string tension is increased. Conversely, when the screw 9 is rotated to bring the frame ends 4,5 closer together, the string tension decreases.

Figure 2:
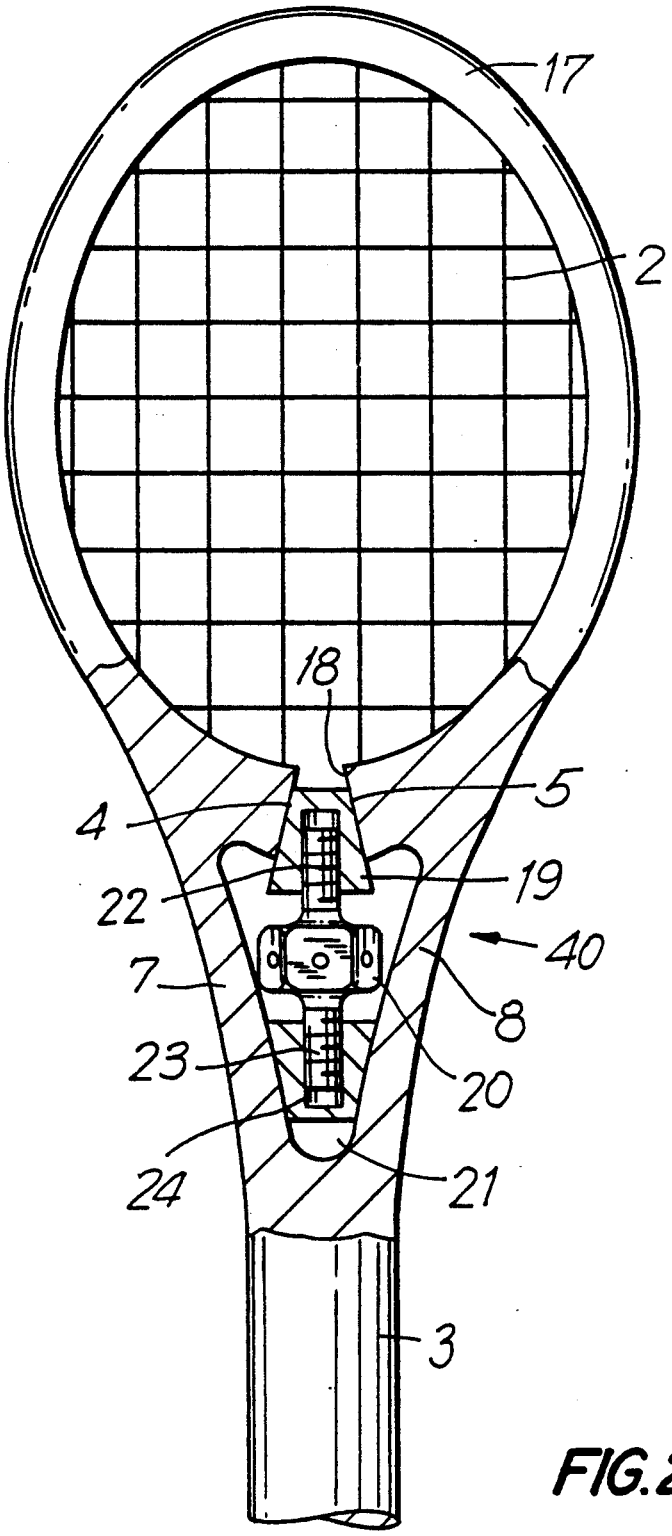
FIG. 2 shows a top view, in partial section of a modified frame having a wedge arranged in a gap thereof.

FIG. 2 shows a modified frame 17 having two ends 4,5 likewise separated from each other by a gap 18 passing transversely through the frame 17. The two ends 4,5 are at a relatively small distance from each other. In the present case, however, the adjusting element comprises a wedge 19 entering a wedgeshaped gap 18 opening towards the holding member 3—from below upward in the drawing of FIG. 2—and thus positively joining the two ends 4,5 of the frame 17.

By shifting the wedge 19 upward with a screw 20 into the gap 18, the width of the gap can be enlarged and the tension of the stringing 2 correspondingly increased.

The screw 20 has a centerline 21 arranged to lie in the plane of the frame 17 and passing through the center of the gap 18. It has an end 22 threaded with a right-hand thread to be screwed into a threaded hole in the wedge 19 and an end 23 threaded with a left-hand thread to be screwed into a threaded hole in another wedge 24. For adjusting its rotary position with a wrench or the like, the screw 20 has a hexagonal segment, similar to that of the segment 15 of FIG. 1, between its two threaded ends 22,23. Other similar elements have the same reference numerals as in FIG. 1.

The wedge 24 pushes against the flanks, opening wedgeshaped towards the frame 17, of the braces 7 and 8, and moves these two braces 7,8 more or less away from each other, depending on the magnitude of the axial adjusting force of the screw 20.

FIG. 3 shows another modified frame 25 which, at its junction with the holding member 3, has a shackle 26 or U-shaped connecting piece elastically and/or plastically compressible in the circumferential direction of the frame 25. This shackle 26 whose bottom end extends down into the throat opening 41, joins the two ends 4,5 of the frame 25 to each other in one piece, thus creating a point of yielding between the two ends 4 and 5 in the direction of the circumference of the frame 25 only.

The two ends 4,5 form a partial gap 27 open towards the stringing 2 and closed by the shackle 26 towards the holding member 3. The gap 27 has a flare or spreadable member 28 with the shape of a circular cone whose axis 29 stands perpendicular to the plane of the frame 25. In this flare 28 is seated a correspondingly shaped wedge 30 having the peripheral shape 31 of a circular cone.

The wedge 30 can be shifted in the flare 28, i.e. transverse to the frame 25 and perpendicular to the plane of the frame 25 (FIG. 4).

The displacement of the wedge 30 is effected with a cap screw 32 capable of being screwed into a central threaded hole of the wedge 30. The cap screw 32 has a bevel 33 acting upon a matching chamfer of an outer edge of the flare 28.

By screwing the cap screw 32 into the threaded hole in the wedge 30, the bevel 33 is pushed towards the wedge 30. Correspondingly, the bevel 33 and the wedge 30 push the two ends 4,5 of the frame 25 somewhat away from each other, so that the gap 27 is widened. This increases the tension in the stringing 2 of the frame 25.

The wedge 30 is further made of a metal, its conical periphery 31 being clad with a solid lubricant, for example plastic with graphite filler.

The embodiments of the invention as described above by way of example may be greatly modified in design. For example, instead of a single adjusting element such as an adjusting screw, two or more adjusting elements may be installed in the region between the two braces of the frame, to push or pull the two ends of the frame more or less towards or away from each other.

Further, instead of a single shackle, two or more shackles may be arranged at the soft point between the two ends of the frame. These shackles may be made of spring steel and fixedly joined to the two ends.

The frame may also have a variable cross section with correspondingly variable moment of resistance along its circumference so that when the tension of the stringing is adjusted, it will be deformed either uniformly or not uniformly as desired within its plane. Other variations within the principles described above will be evident to those skilled in this art.

While the invention has been described and illustrated in connection with preferred embodiments, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

What is claimed is:

1. A game racket comprising a head portion joined to a rigid handle portion by way of an intermediate throat portion, said head portion comprising an annular frame member extending in a plane and comprising where it joins the handle portion a first pair of adjacent brace members which define the sides of an opening in the throat portion and a second pair of end portions at the top of the throat opening and which are spaced from one another to form a gap, stringing connected across the annular frame member, said frame member and said first pair of brace members being slightly resilient and deformable in the said plane such that when the size of the said gap between the end portions is varied the stringing tension is varied, an elastically deformable shackle member extending into the throat opening between the brace members and joined to and across the end portions, and shackle member being deformable substantially only in the circumferential direction of the frame member, thereby to reduce vibrations of the end portions, adjusting means in the said gap between the end portions and bearing against the end portions and capable upon actuation to vary the size of the said gap and thereby vary the stringing tension, said adjusting means comprising a wedge having a threaded member and acting in the gap between the two end portions of the frame and pushing the two end portions substantially away from each other when the threaded member is rotated, said wedge being arranged perpendicular to the plane of the frame and being displaceable when the threaded member is rotated.

2. A game racket comprising a head portion joined to a rigid handle portion by way of an intermediate throat portion, said head portion comprising an annular frame member extending in a plane and comprising where it joins the handle portion a first pair of adjacent brace members which define the sides of an opening in the throat portion and a second pair of end portions at the top of the throat opening and which are spaced from one another to form a gap, stringing connected across the annular frame member, said frame member and said first pair of brace members being slightly resilient and deformable in the said plane such that when the size of the said gap between the end portions is varied the stringing tension is varied, an elastically deformable shackle member integral with the end portions and extending into the throat opening between the brace members and joined to and across the end portions, said shackle member being deformable substantially only in the circumferential direction of the frame member, thereby to reduce vibrations of the end portions, said shackle member being U-shaped with the bottom of the U extending toward the handle portion, adjusting means in the said gap between the end portions and bearing against the end portions and capable upon actuation to vary the size of the said gap and thereby vary the stringing tension, said adjusting means being positioned inside the shackle member U-shape.

3. The game racket of claim 2, wherein the said brace members and end portions are integral with the frame member.

4. A frame according to claim 2 wherein, the adjusting means comprises a wedge acting in the gap between the two end portions of the frame and pushing the two end portions substantially away from each other with the aid of a screw.

5. A frame according to claim 4, wherein the wedge is arranged transverse to the frame and displaceable in the plane of the frame by means of the screw.

* * * * *